United States Patent [19]

Charland

[11] 4,215,849

[45] Aug. 5, 1980

[54] VEHICLE FRAME PULLING AND RESHAPING APPARATUS

[76] Inventor: Roger Charland, 1424 SW. 1st Ave., Deerfield Beach, Fla. 33441

[21] Appl. No.: 1,069

[22] Filed: Jan. 5, 1979

[51] Int. Cl.[2] ..... B66C 23/60; B66D 3/08

[52] U.S. Cl. ..... 254/326; 72/705; 254/226; 254/227

[58] Field of Search ..... 254/139.1, 186, 139; 72/705

[56] References Cited

U.S. PATENT DOCUMENTS

| | | | |
|---|---|---|---|
| 2,615,584 | 10/1952 | Adams | 254/139.1 X |
| 2,759,703 | 8/1956 | Holmes | 254/186 R |
| 3,092,367 | 6/1963 | Selby | 254/139.1 |
| 3,181,707 | 5/1965 | Janssen | 254/139.1 X |
| 3,578,290 | 5/1971 | Gof | 254/139.1 |
| 3,589,680 | 6/1971 | Kuhn | 254/139.1 X |
| 3,901,478 | 8/1975 | Peterson | 254/139.1 |

*Primary Examiner*—John M. Jillions
*Attorney, Agent, or Firm*—A. Lebrun

[57] ABSTRACT

An apparatus adapted to exert traction on the frame of a vehicle to straighten or reshape the same and characterized by having the front or forward portion free of the winch and of the actuating mechanism for the winch, by allowing to operatively reach a frame at a point higher than the apparatus and close to the floor, by a chain extending along the cable and forming a safety guard for the operator, and by being portable in the trunk of a car. This apparatus includes a base plate, wheels rollably supporting the base plate and including a swivelling wheel to easily position the apparatus on the floor relative to a vehicle, a removable post, a winch rearward of the post, a cable running on a cable guide pulley mounted on the upper end of the post, a chain anchoring the base plate on the floor, and another chain holding the post upright and forming a guard over the cable between the winch and the post.

6 Claims, 6 Drawing Figures

VEHICLE FRAME PULLING AND RESHAPING APPARATUS

This invention relates to a winch apparatus of the type adapted to reshape or straighten the frame of a vehicle by pulling thereon.

There have been patented many apparatuses of the above type to be use in body shops or garages for straightening or reshaping the vehicle frames. Although they are generally adapted to perform the required functions they are found each lacking on one point or another and they even have some functional shortcomings. For instance, their construction is such that they cannot operatively reach a frame at a point higher than their uppermost part and/or they cannot effectively reach a frame at a point very close to the floor.

It is a general object of the present invention to provide a vehicle frame pulling and reshaping apparatus of the above type which substantially avoids the aforementioned disadvantages.

It is a more specific object of the present invention to provide a vehicle frame pulling and reshaping apparatus of the above type which allows to operatively reach a frame at a point higher than the uppermost part of the apparatus and at a point very close to the floor.

It is another general object of the present invention to provide a vehicle frame pulling and reshaping apparatus of the above type which is particularly adapted to be portable for instance in the trunk of a car.

It is another object of the present invention to provide a vehicle frame pulling and reshaping apparatus of the above type which has a front or forward portion free of the winch and of the actuating mechanism therefor.

It is a further object of the present invention to provide a vehicle frame pulling and reshaping apparatus of the above type which is provided with wheels and in particular a swiveling wheel arranged to easily position the apparatus relative to a vehicle.

It is still another object of the present invention to provide a vehicle frame pulling and reshaping apparatus of the above type wherein there is a post to guide the cable of the winch and a chain holding the post in place and also arranged to form a guard extending lengthwise over the cable for the protection of the operator.

It is still further object of the present invention to provide a vehicle frame pulling and reshaping apparatus of the above type with an electromagnetic brake to firmly stop the drum and the cable of the winch at any moment during the operation before slackening of the pull on the frame.

The above and other objects and advantages of the present invention will be better understood with reference to the following detailed description of a preferred embodiment thereof which is illustrated, by way of example, in the accompanying drawings; in which.

Figure 1:
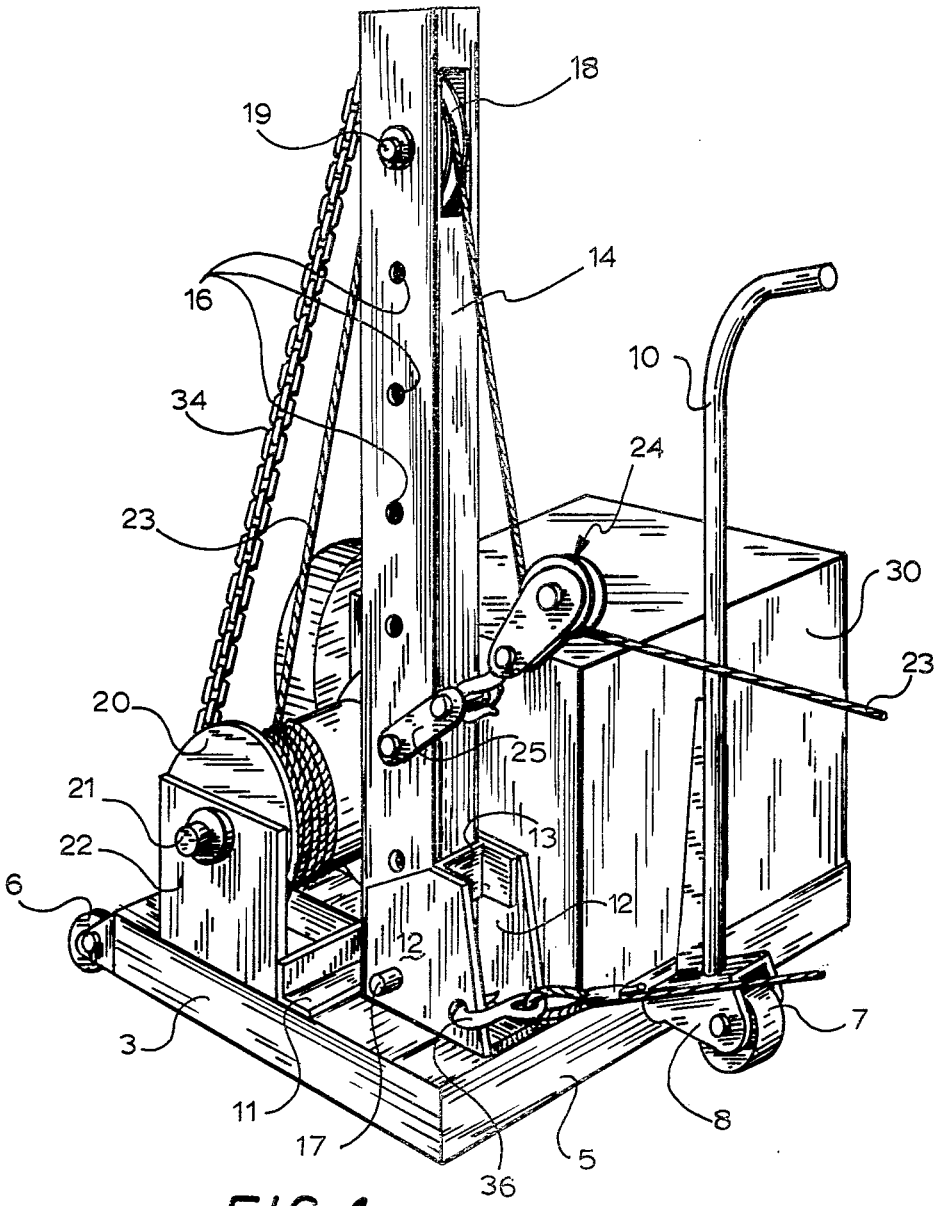
FIG. 1 is a perspective view of a vehicle frame pulling and reshaping apparatus according to the present invention.
Figure 2:
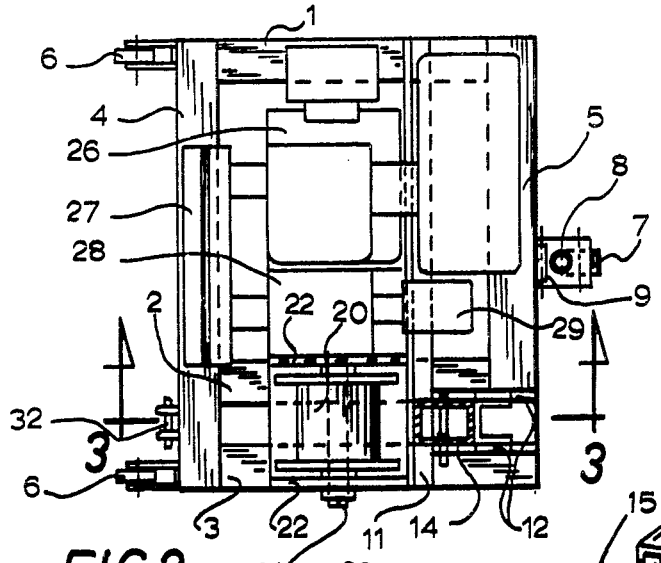
FIG. 2 is a top view of the vehicle frame pulling and reshaping apparatus with the post shown in cross-section.
Figure 4:
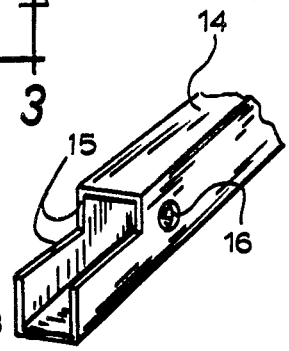
FIG. 4 is a perspective view of the lower end of the post forming part of the apparatus.

The illustrated vehicle frame pulling and reshaping apparatus comprises a rectangular base plate made of longitudinal tubular members 1, 2, and 3 which are welded at their ends to a pair of transverse tubular member 4 and 5. A pair of rear wheels 6 are fixed to the rear transverse tubular member 4 and rearwardly project therefrom.

A front swivelling wheel 7 is swivelly connected to a bracket 8 which is pivoted to the front transverse tubular member 5 by a transverse hinge 9. A handle 10 is secured to the bracket 8 such that upon forward pivoting thereof, the front of the base plate is lifted off the floor by this front swivelling wheel 7 and carried on the three wheels 6, 6 and 7 which engage the floor to rollably displace and positon the whole apparatus.

Figure 3:
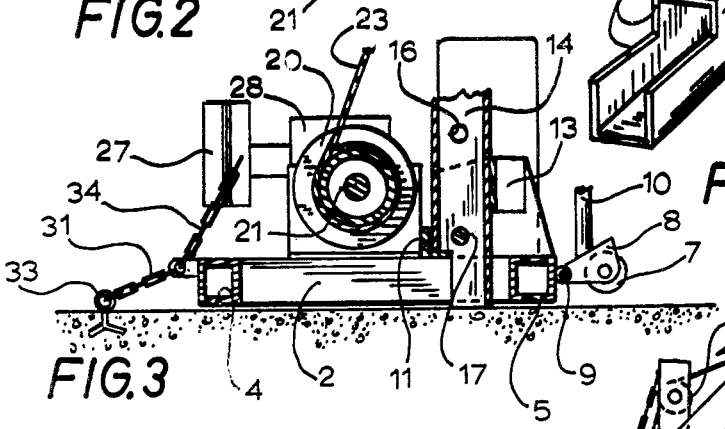
FIG. 3 is a cross-sectional view as seen along line 3—3 in FIG. 2.

An angle member 11 is secured transversely over the longitudinal tubular members 1, 2 and 3. A pair of plates 12 are rigidly secured to the longitudinal members 2 and 3 respectively and cooperatively form with a spacer 13 a recess for the lower end of a tubular post 14. The lower end of the post 14 downwardly extends between the longidudinal members 2 and 3 and is cut out at 15 to provide space for the angle member 11, as best shown in FIG. 3. The post 14 is provided with apertures 16 extending transversely there through. A pin 17 removably engages into the lowermost aperture 16 and in a corresponding hole in the plates 12 to operatively secure the post 14 on the base.

A cable guide pulley 18 is rotatably mounted between the laterally spaced apart sides of the post 14 at the top of the latter. A pin or axle 19 extends in the uppermost aperture 16 and so rotatably supports the cable guide pulley.

A winch is mounted on the afore described base plate rearward of the post 14 and comprises a conventional drum for the cable, a conventional eletric motor, a conventional belt drive, and a conventional speed reducer gearbox. The cable drum 20 is rotatably carried by a transversely extending axle 21 which is mounted on brackets 22. The drum 20 is aligned with the post 14 such that the cable 23 can easily wind evenly on the drum. The cable 23 extends from the drum 20 passes on the cable drive pulley 18 and is downwardly runned by a vertically adjustable guide pulley unit 24. A shackle 25 is pinned in any of the holes 16 to provide attachment of the guide pulley unit 24 at any selected height relative to the post 14.

The electric motor 26 of the winch is connected to a belt drive 27 operating a speed reducer gearbox 28 whose output shaft is keyed to the axle 21 of the drum to rotate the latter. The motor, belt drive, and speed reducer gearbox may be of any appropriate and known construction and the details thereof do not form part of the present invention. An electromagnetic brake 29 is connected to the gearbox input to selectively and positively brake the drum before any slackening of the cable occurs. A rectangular housing 30 fits on the base over the actuating elements and the brakes for the drum at the exception of the belt drive 27 which stands outside of this housing.

The apparatus is operatively anchored on the floor by a short chain 31 which is releasably secured at one end by a pin 32 to the transverse rear member 4 and at the other end to an anchor bolt or ring 33 in the floor. Another chain 34 is connected at one end by the pin 32 to the transverse rear member 4, extends upwardly and forwardly above the cable run from the drum 20 to the cable guide pulley 18, and is secured to the upper end of the post 14. Thus, the chain 34 extends longitudinally and outward of this cable run to form a guard for the safety of the operator.

Figure 5:
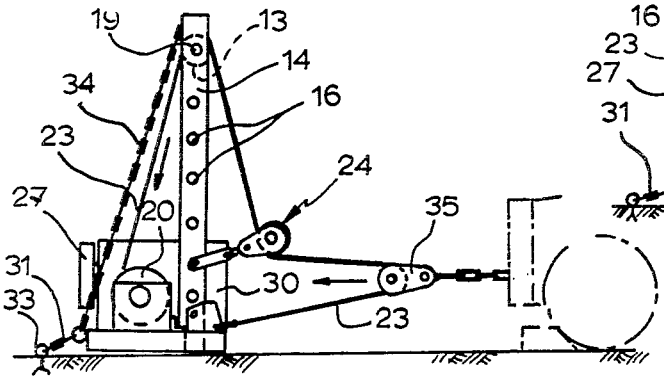

The appartus is generally used as shown in FIGS. 1 and 5 with the cable 23 running forwardly and rearwardly around the pulley 35 and hooked at the free end to one of the plates 12 by the hook 36. The shackle 25 may be connected in any of the available holes 16 of the post 14 to select the desired height for the pulley 35. It must be noted that the front portion of the apparatus is free of the winch and the actuating mechanisms therefor and this allows to connect the shackle 25 in the lowest available hole 16 and thus to have the pulley 35 reaching the frame at a point very close to the floor.

Figure 6:
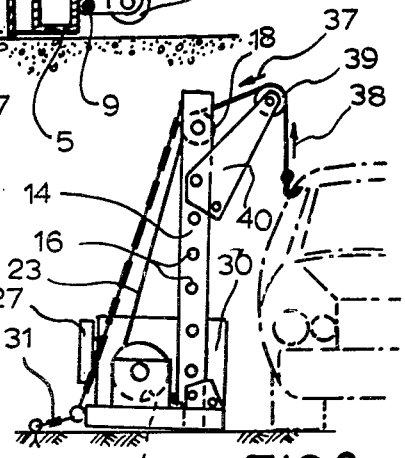
FIGS. 5 and 6 are schematic views illustrating as many different modes of operation of the apparatus.

As shown in FIG. 6, the cable guide pulley 18 at the top of the post 14 allows to extend the cable 23 upwardly forward of the post to pull in a rearward and downward direction, indicated by the arrow 37 either directly on the vehicle frame at a point above the uppermost part of the apparatus, or indirectly upwardly in the direction of the arrow 38 by means of a pulley 39 on the end of an arm 40. Thus, this allows to conveniently reshape the roof or a door of a vehicle.

What I claim is:

1. A vehicle frame pulling and reshaping apparatus comprising a base plate, wheels rollably carrying the base plate, a post having a lower end removably attached to the base plate and an upper end upwardly projecting from the base plate, a winch mounted on the base plate and positioned rearward of the post relative to a vehicle operatively positioned for repair forwardly relative to the apparatus and including a cable drum rotatable about a transverse axis and positioned rearward of the post, an upper cable guide pulley rotatively connected to the upper end of the post, a lower cable guide pulley operatively connected to the post selectively along the length thereof, in any predetermined position between the lower end of the post and the upper cable guide pulley, a cable wound on the cable drum, operatively passing over the upper cable guide pulley, longitudinally extending operatively forwardly from under the lower cable guide pulley and operatively connecting to a vehicle frame and side pulling on the latter, and having a cable run extending upwardly and forwardly from the cable drum to the upper cable guide pulley, a brake operatively connected to the winch and controlling the rotation thereof and the traction exerted by the cable on the vehicle frame, a chain operatively attached to the upper end of the post and to the base plate rearward of the post, operatively extending along the cable run rearwardly overlying the latter, and rearwardly restraining the post against operative forward pulling thereon by the cable, and an anchoring device connected to the base plate and operatively securing the latter relative to the ground against pulling operation by the winch.

2. A vehicle frame pulling and reshaping apparatus as defined in claim 1, wherein said chain is releasably connected to the base plate and operatively transportable unitarily with the post and the guide pulley upon removal of the post from the base plate.

3. A vehicle frame pulling and reshaping apparatus as defined in claim 2, wherein the lower end of the post extends downwardly into the base plate and a pin transversely extends through the lower end thereof and operatively secures the same to the base plate.

4. A vehicle frame pulling and reshaping apparatus as defined in claim 3, wherein the wheels include a swivelling front wheel pivotally connected to the base plate and operatively engageable with the ground and a handle is connected to the swivelling front wheel and engages the latter with the ground upon forward tilting of the handle.

5. A vehicle frame pulling and reshaping apparatus as defined in claim 4, wherein axle means transversely extends through the upper end of the post and rotatively supports the upper cable drive pulley.

6. A vehicle frame pulling and reshaping apparatus as defined in claim 5, wherein said winch includes an electric motor and a speed reducer gearbox, and a housing is removably secured to the base plate over said motor, brake, and gearbox and operatively encloses the same laterally of the post and winch.

* * * * *